US006881307B2

(12) United States Patent
Ikegawa

(10) Patent No.: US 6,881,307 B2
(45) Date of Patent: Apr. 19, 2005

(54) IMAGE CREATING APPARATUS AND IMAGE RECORDING APPARATUS

(75) Inventor: Akihito Ikegawa, Sakai (JP)

(73) Assignee: Minolta Co., Ltd., Osaka (JP)

( * ) Notice: Subject to any disclaimer, the term of this patent is extended or adjusted under 35 U.S.C. 154(b) by 192 days.

(21) Appl. No.: 10/274,870

(22) Filed: Oct. 22, 2002

(65) Prior Publication Data

US 2003/0079986 A1 May 1, 2003

(30) Foreign Application Priority Data

Oct. 26, 2001 (JP) ..... 2001-329118
Sep. 2, 2002 (JP) ..... 2002-256867

(51) Int. Cl.[7] ..... C25D 17/00
(52) U.S. Cl. ..... 204/230.2; 204/242; 204/252
(58) Field of Search ..... 204/242, 252, 204/230.2, 230.8

(56) References Cited

U.S. PATENT DOCUMENTS 5,268,082 A 12/1993 Oguro et al.
6,249,076 B1 * 6/2001 Madden et al. ..... 310/363

FOREIGN PATENT DOCUMENTS

| | | |
|---|---|---|
| JP | 4-275078 | 9/1992 |
| JP | 6-6991 | 1/1994 |
| JP | 8-76700 | 3/1996 |
| JP | 9-32718 | 2/1997 |
| JP | 11-72722 | 3/1999 |

* cited by examiner

*Primary Examiner*—Donald R. Valentine
(74) *Attorney, Agent, or Firm*—McDermott Will & Emery LLP

(57) ABSTRACT

In order to provide an image creating apparatus which is driven at a high speed by a low voltage and realizes high contrast, the image creating apparatus of the present invention applies a voltage selectively to surfaces of arranged plural polymeric electrolyte films and generate a potential difference between both surfaces of the polymeric electrolyte films to which the voltage is applied to deform the polymeric electrolyte films. This image creating apparatus can provide an optical shutter of an image recording apparatus and a reflection or transmitting type image display device.

21 Claims, 8 Drawing Sheets

(a)

(b)

IMAGE CREATING APPARATUS AND IMAGE RECORDING APPARATUS

This application is based on applications No. JP 2001-329118 and No. JP 2002-256867 filed in Japan, the content of which is hereby incorporated by reference.

BACKGROUND OF THE INVENTION

1. Field of the Invention

The present invention relates to an improved image creating apparatus. More concretely, the invention relates to an apparatus for creating an image by physically deforming a plurality of film type movable pieces provided to pixels, respectively, and an image recording apparatus having the image creating apparatus.

2. Description of the Related Art

Conventionally, an apparatus for creating an image by selectively deforming a plurality of arranged movable pieces has been known. In this apparatus, the movable pieces are deformed so as to allow a light to be reflected or transmitted (pass) in the segments. A plurality of arranged movable pieces are selectively deformed so that a light image in which those segments form one pixel can be created.

For example, a plurality of movable pieces having light shielding property are arranged linearly so that a line array is composed, and deformation/nondeformation of the plural movable pieces is selectively controlled so that an image (pattern) is created into a linear sate. A light is emitted from one side of the line array and only a light of the pattern created on the line array is allowed to pass, so that a linear light image is created.

In addition, a plurality of movable pieces are arranged into a plane shape so as to compose a matrix array, and surfaces of the movable pieces are colored and deformation/nondeformation of the plural movable pieces is selectively controlled, so that a plane image is created. A light image is created by a reflected light from nondeformed movable pieces.

In these image creating apparatuses, movable pieces which are arranged into a two-dimensional plane shape or linear shape are physically deformed by a heat or a voltage. The image creating apparatus using movable pieces has an advantage such that utilization efficiency of a light is higher than that of an image creating apparatus using liquid crystal or the like.

Japanese Patent Application Laid-Open No. 8-076700 (1996) describes that a film is movable (deformed) by electrostatic power and an optical shutter is composed. Moreover, Japanese Patent Application Laid-Open No. 11-72722 (1999) describes that an optical shutter is composed by a film which is movable by bi-metal or electrostatic power. Here, a film piece which is a movable piece is deformed by adsorption/separation power due to electrostatic power. Moreover, bi-metal is constituted so that two kinds of metals having different linear expansion coefficients are laminated and are deformed by a difference in expansion coefficient of both the metals. A plurality of such movable pieces are arranged and their opening/closing is controlled so that an image is created.

However, in order to deform a film by means of electrostatic power, a film piece should be lengthened to a certain extent so that sufficient driving force can be secured. For this reason, in the apparatus for creating an image by deforming the film piece by means of the electrostatic power, there arises a problem that an operating speed is slow. Meanwhile, since the bi-metal has low deformation coefficient, there arises a problem that the utilization efficiency of a light is not good and contrast is low. Further, in the case where a film is deformed by the electrostatic power, it is necessary to apply a high voltage to the film. Moreover, in the case where the bi-metal is deformed, a voltage which is high like the former case is not required, but lowering of the driving voltage is liable to be improved.

OBJECTS AND SUMMARY

The present invention is devised in order to solve the above problems, and its object is to provide an improved image creating apparatus. More concretely, it is an object of the invention to provide an image creating apparatus which is driven by a low voltage and realizes high contrast. Moreover, it is an object of the invention to provide an image creating apparatus in which a driving speed is high. Further, it is an object of the invention to provide an inexpensive image creating apparatus. Moreover, it is an object of the invention to provide a new and useful image recording apparatus using the image creating apparatus.

In order to achieve the above objects and another objects, an image creating apparatus from a certain aspect of the present invention has a plurality of arranged polymeric electrolyte films, voltage applying device for applying a voltage to surfaces of the polymeric electrolyte films to generate a potential difference between both surfaces of the polymeric electrolyte films to which the voltage was applied so as to deform the polymeric electrolyte films, and controller for controlling the voltage applying device so that a voltage is selectively applied to the plural polymeric electrolyte films.

In a certain aspect, the voltage applying device applies a voltage to electrode films covering the polymeric electrolyte films so as to apply a voltage to the surfaces of the polymeric electrolyte films.

In a certain aspect, the image creating apparatus further has movable members which are formed by the polymeric electrolyte films and the electrode films covering them in closed spaces, and the movable members are soaked in liquid put into the closed spaces.

In a certain aspect, the image creating apparatus creates an image by providing a light source to a back surface of the apparatus and by a light which transmits through the apparatus.

In a certain aspect, the polymeric electrolyte films are substantially bent by not less than 90° so that switching of the respective pixels are executed.

In a certain aspect, the liquid is colored and the polymeric electrolyte films are bent by an angle of less than 90°, so that the switching of the pixels is executed.

An image recording apparatus from another aspect has the image creating apparatus as an exposing apparatus, and creates an electrostatic latent image by a light image corresponding to selective deformation of the plural polymeric electrolyte films by means of the voltage applying device and the controller.

An image creating apparatus from another aspect has a plurality of arranged polymeric electrolyte films, voltage applying device for applying a voltage to surfaces of the polymeric electrolyte films and generating a potential difference between both surfaces of the polymeric electrolyte films to which the voltage was applied to deform the polymeric electrolyte films, controller for controlling the voltage applying device so that a voltage is selectively applied to the plural polymeric electrolyte films, and flexible members which are arranged in vicinities of the polymeric electrolyte films. The polymeric electrolyte films are shifted by pressurizing the flexible members.

In a certain aspect, the image creating apparatus further has light transmitting members which are opposed to the flexible members, and a liquid held to peripheries of the flexible members to be capable of flowing. The liquid between light transmitting members and the flexible members is pushed out when the flexible members are pressurized, and the liquid flows into between the light transmitting members and the flexible members at the time of releasing the pressurizing.

BRIEF DESCRIPTION OF THE DRAWINGS

These and other objects and features of the present invention will become apparent from the following description of preferred embodiments thereof taken in conjunction with the accompanying drawings, in which.

In the following description, like parts are designated by like reference numbers throughout the several drawing.

DETAILED DESCRIPTION OF THE PREFERRED EMBODIMENTS

"Image" in this specification is a pattern which is created by selectively deforming arranged movable pieces. Moreover, "image" is not limited to an image composed of a plurality of movable pieces arranged on a two-dimensional plane, and includes an image composed of a plurality of movable pieces arranged linearly. Namely, in this specification, a linear pattern which is created by turning on/off a plurality of pixels arranged linearly is also "image". Meanwhile, "light image" in this specification is an image which is created in such a manner that a light is reflected from an image created by an image creating apparatus of the present invention or a light is transmitted through the created image.

There will be explained below preferred embodiments of the present invention with reference to the drawings.

[First Embodiment]

In the first embodiment, a plurality of movable pieces arranged one-dimensionally are selectively curved, so that a one-dimensional image is formed by deformation/nondeformation of the movable pieces. Namely, in the first embodiment, "image" means a pattern which is created by combinations of deformation/nondeformation of the plural movable pieces arranged one-dimensionally in a line array unit.

Figure 1:
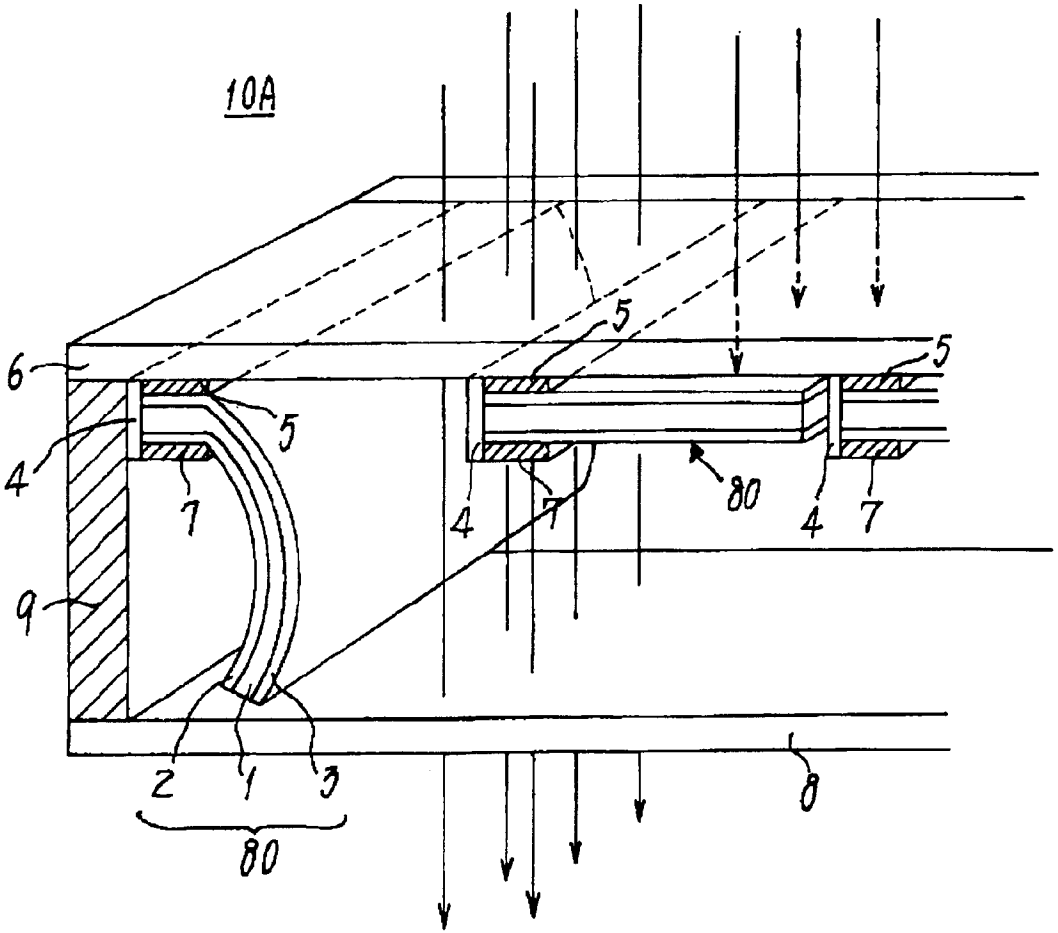
FIG. 1 is a perspective view showing one part of a line array unit 10A according to a first embodiment.

FIG. 1 is a perspective view showing one part of a line array unit 10A according to the first embodiment. In FIG. 1, for easy viewing, wall members 9 at the front side are not shown (see FIG. 2). The line array unit 10A has an elongate transparent substrate 6, and an upper electrode plate 5 which is extended from one surface of the transparent substrate 6 to a widthwise direction of the transparent substrate 6. A plurality of upper electrode plates 5 are provided in a longitudinal direction of the transparent substrate 6 with predetermined gaps.

Holding members 4, which contact with side surface extended to the longitudinal direction of the transparent substrate 6 and are jointed vertically to the transparent substrate 6, are provided on the upper electrode plates 5, respectively. The holding members 4 are made of insulating materials. Further, lower electrode plates 7, which are jointed vertically to the holding members 4, are provided on ends of the holding members 4, which are not jointed to the transparent substrate 6, respectively. The upper electrode plates 5, the holding members 4 and the lower electrode plates 7 form U shapes.

One end of a film 80 as a movable piece is supported by a U-shaped concave section so that a cantilever is formed. The film 80 has an approximately equal width with a width of the transparent substrate 6 in the widthwise direction of the transparent substrate 6, and has an approximately equal length with an arranging gap of the plural electrode plates 5 in the longitudinal direction of the transparent substrate 6.

A transparent plate 8 is provided parallel with the transparent substrate 6 so as to be opposed to the surface of the transparent substrate 6 at a side where the films 80 are supported by the electrode plates 5 and the holding members 40. The transparent substrate 6 is parallel with the transparent plate 8 so as to be separated with a predetermined gap by the rectangular wall members 9 jointed to four sides of the transparent substrate 6 and the transparent plate 8. Namely, the opposed transparent substrate 6 and transparent plate 8 and the four wall members 9 form a cuboid, and a closed space is formed therein. The closed space is charged with pure water.

The gap between the transparent substrate 6 and the transparent plate 8 is such that even in the case where the films 80 supported by the electrode plates 5 and the holding members 4 are curved to be deformed, the films 80 do no interfere (contact) with the transparent plate 8.

The film 80 is formed by an ion-exchange film 1 as a polymeric electrolyte film and electrode films 2 and 3 which covers both surfaces of the ion-exchange film 1. The ion-exchange film 1 contains water. The upper electrode film 3 or the lower electrode film 2 is composed of a material having light shielding property or light shielding paint is applied to the upper electrode film 3 and/or the lower electrode film 2. As a result, the films 80 absorb an entering light and shield advancing of the light.

More concretely, as the ion-exchange film 1, a fluoroplastic ion-exchange film, a polystyrenesulfonic acid film or the like can be used. Although the ion-exchange film 1 contains water as mentioned above, the closed space formed by the transparent substrate 6, the transparent plate 8 and the wall members 9 is charged with the water in order to prevent the water from evaporating from the ion-exchange film 1. Namely, the ion-exchange film 1 is soaked in water so that a hydrous state of the ion-exchange film 1 is maintained.

When the moisture of the ion-exchange film 1 is prevented from evaporating, it is not always necessary to charge the closed spaces with water. For example, a circumference of the ion-exchange film 1 is coated with evaporation preventing resin, so that the moisture of the ion-exchange film 1 may be prevented from evaporating. Further, the films 80 are connected with tubes so that water may be suitably supplied to the ion-exchange film. Furthermore, the films 80 are not always soaked in water, but a mechanism which moves a water storage tank and the films 80 relatively is provided so that water may be supplied from the water storage tank to the films 80 periodically or only when necessary. A liquid which is contained in the ion-exchange film 1 and a liquid which is put into the closed spaces may be a solution containing electrolyte such as brine (preferably aqueous solution) as well as pure water.

In the example of FIG. 1, the materials of the upper electrode film 3 and the lower electrode film 2 are nickel. As the materials of both the electrode films, noble metal such as gold, platinum, palladium or iridium, or electrically conductive macromolecule such as polypyrrole, polythiophene or polyaniline can be used. Moreover, as a method of coating the ion-exchange film 1 with the electrode films 2 and 3, a sputtering method, a deposition method, an electroplating method, a coating method, a pressure welding method, a solvent welding method or the like can be adopted.

The upper electrode film 3 which is provided on the surface of the ion-exchange film 1 on the side opposed to the transparent substrate 6 comes in contact with the upper electrode plate 5. Meanwhile, the lower electrode film 2 comes in contact with the lower electrode plate 7 in a state that it is insulated from the upper electrode plate 5 with the insulating holding member 4.

In the line array unit 10A having such a structure, when a voltage is applied to between the electrode 5 and the electrode 7, a potential difference is generated between the upper electrode film 3 which comes in contact with the upper electrode plate 5 and the lower electrode film 2 which comes in contact with the lower electrode plate 7. As a result, the film 80 is curved to be deformed. The plural films 80 are selectively deformed so that a one-dimensional image is created in the line array unit 10A. At this time, when a light is supplied from the outside of the transparent substrate 6 uniformly and an image is created by the plural films 80, a light image is created on the side of the transparent plate 8 by the lights which transmit through the films 80 without shielding. Here, in the line array unit 10A of FIG. 1, the films 80 are curved by about 90° by deformation, but the films 80 may be curled up due to deformation by adjusting a film thickness, a film length, an applying voltage and the like.

Figure 2:
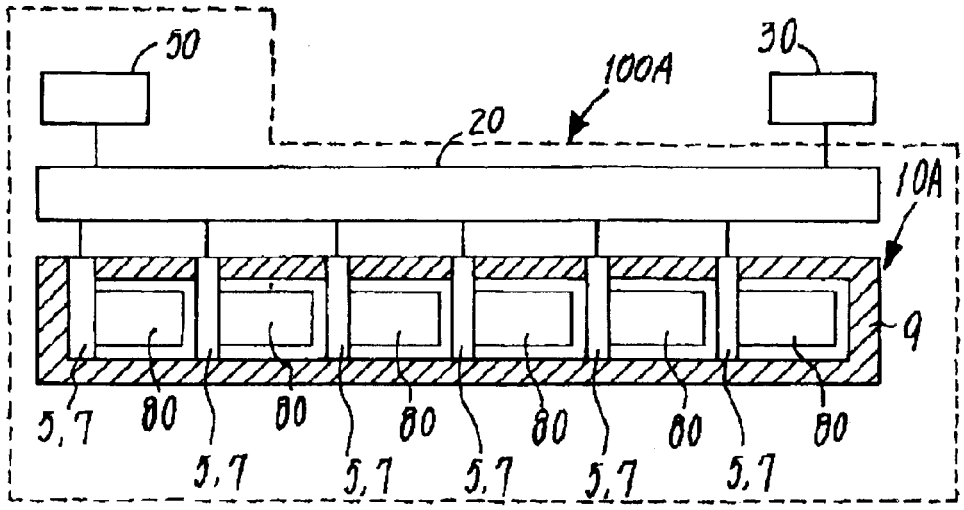
FIG. 2 is a diagram showing a circuit configuration of an image creating apparatus 100 according to the first embodiment.

Next, there will be explained below a structure for selectively deforming the plural films 80 arranged linearly with reference to FIG. 2. FIG. 2 shows a circuit configuration of the image creating apparatus 100A, and is a diagram in which the line array unit 10A is viewed from the side of the transparent substrate 6. The image creating apparatus 100A is composed of the line array unit 10A, a driving circuit 20 and a controller 50. The plural electrode plates 5 and 7 of the line array unit 10A are connected to the driving circuit 20. The driving circuit 20 is controlled by the controller 50 to selectively apply a voltage from a power source 30 to the electrode plates 5 and 7.

Figure 3:
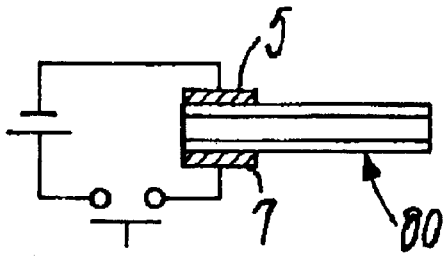
FIGS. 3(*a*) and (*b*) are diagrams showing principle of a deformation driving of a film 80; (a) shows a state that a voltage is not applied, and (b) shows a state that a voltage is applied.
Figure 3:
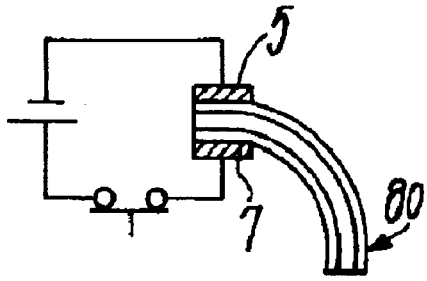

FIGS. 3(*a*) and 3(*b*) are diagrams for explaining principle of driving of the films 80 by means of the driving circuit 20. In the state that a switch is cut off, a voltage is not applied to between the electrode plates 5 and 7, and thus the films 80 are not deformed (FIG. 3 (*a*)). When a voltage is applied to between the electrode plates 5 and 7, a voltage is applied to the surfaces of the ion-exchange films 1 via the electrode films 3 and 2, so that a potential difference is generated in a film thicknesswise direction of the ion-exchange films 1. As a result, the films 80 are deformed (FIG. 3(*b*)). Here, in the examples of FIGS. 3(*a*) and 3(*b*), the films 80 are curved to the sides of the lower electrode plates 7 to which a plus voltage is applied.

Such switching is selectively executed for a plurality of pixels by controlling the driving circuit 2 by means of the controller 50, so that a desired image can be created on the line array unit 10A.

[Applicable Example]

Figure 4:
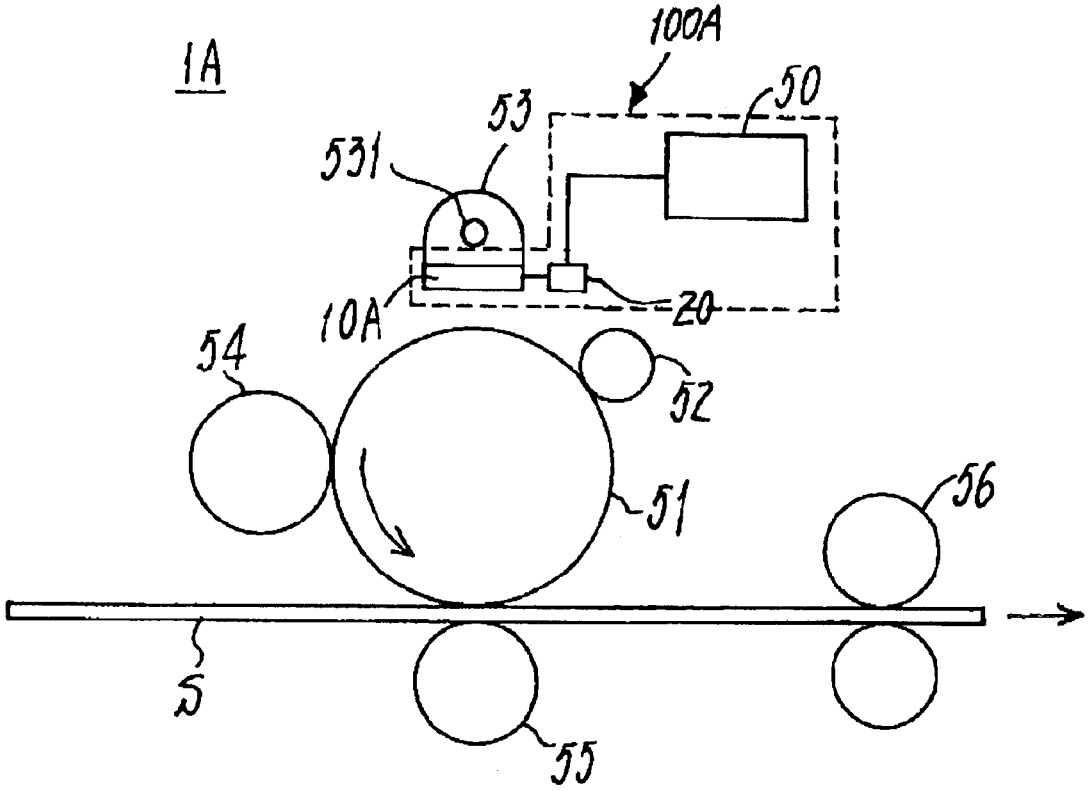
FIG. 4 is a schematic diagram showing a structure of an image recording apparatus 1A which adopts the image creating apparatus according to the first embodiment.

There will be explained below an applicable example in which the image creating apparatus 100A is used as an optical shutter for forming an electrostatic latent image on a photoreceptor. FIG. 4 is a schematic diagram showing a structure of an image recording apparatus 1A. The image recording apparatus 1A is an apparatus for creating a toner image on a sheet S by means of an electrophotographic system. Here, the image creating apparatus 100A allows a light to transmit selectively the pixels, so that a light image is created. The image recording apparatus 1A is mainly composed of a drum-shaped photoreceptor 51, and a charging device 52, an exposing device 53, a developing device 54, and a transfer device 55 are provided around the photoreceptor 51. Moreover, a fixing device 56 is provided to a destination to which a sheet S is carried by the photoreceptor 21 and the transfer device 55. The above-mentioned components are extended to a direction which is vertical to a sheet surface.

The exposing device 53 is composed of an exposing lamp 531 and the image creating apparatus 100A shown in FIGS. 1 and 2. The photoreceptor 51 is charged uniformly in a longitudinal direction on a portion opposed to the charging device 52. The surface of the charged photoreceptor 51 moves to a position opposed to the exposing device 53 due to its rotation. In a state that a light is emitted from the exposing lamp 531, a plurality of films of the line array unit 10A are selectively curved, so that an image is created on the line array unit 10A and a light image corresponding to the image is emitted to the photoreceptor 51. Namely, the light image corresponding to the image created on the line array unit 10A is emitted to the longitudinal direction of the photoreceptor 51. The creation of the image on the line array unit 10A and the emission of the light corresponding to the image to the photoreceptor 51 are changed in time series and the photoreceptor 51 is rotated to a peripheral direction at a predetermined speed, so that a two-dimensional electrostatic latent image is created on the peripheral surface of the photoreceptor 51 by the emission of the light. The electrostatic latent image is developed by the developing device 54 by using toner. The toner image which is created on the photoreceptor 51 by the developing device 54 is transferred onto the sheet S by the transfer device 55. The toner image transferred onto the sheet S is fixed by the fixing device 56.

[Second Embodiment]

In the second embodiment, the plural movable pieces arranged two-dimensionally are selectively curved, so that a two-dimensional image is created by a combination of deformation/nondeformation of the movable pieces. Namely, "image" in the second embodiment means a pattern which is created by the combination of the deformation/nondeformation of the plural movable pixels arranged two-dimensionally in the matrix array unit.

Figure 5:
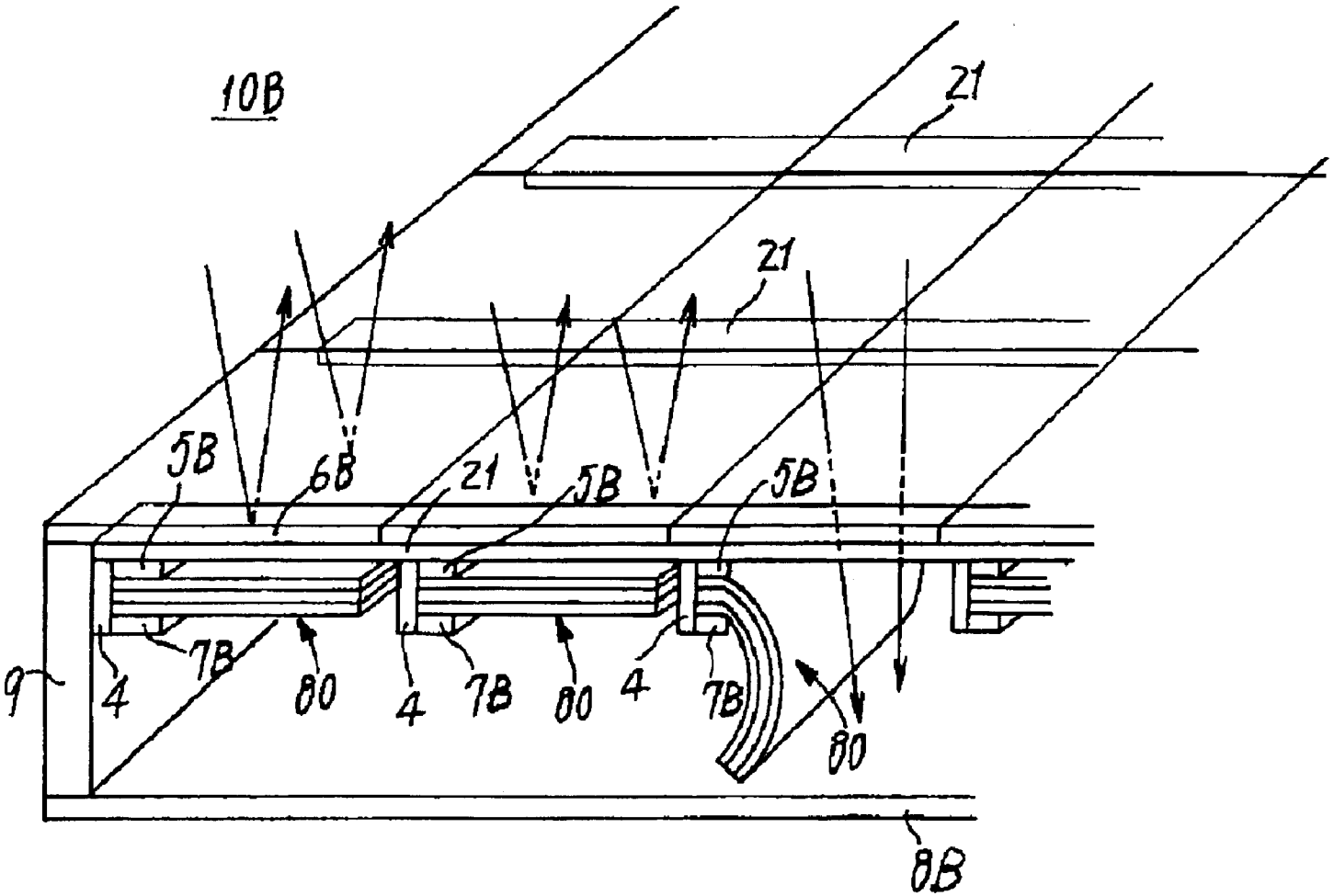
FIG. 5 is a perspective view showing one part of a matrix array unit 10B according to a second embodiment.

FIG. 5 is a perspective view showing a part of the matrix array unit 10B according to the second embodiment. In FIG. 5, for easy viewing similarly to FIG. 1, wall members 9B on the front side are not shown.

In the present embodiment, the plural films 80 are arranged in a row direction (a lateral direction in FIG. 5) and a string direction (a widthwise direction in FIG. 5), so that an image creating apparatus composed of pixels arranged two-dimensionally can be realized. For this reason, a matrix array unit 10B has transparent substrate 6B. Transparent electrodes as a plurality of gate electrodes 21 which extend to the row direction are jointed to one surface of the transparent substrate 6B (lower surface in FIG. 5) with constant gaps in the string direction. Further, electrically conductive spacers 5B are provided with predetermined gaps in a direction intersecting perpendicularly to the gate electrodes 21 so as to b overlapped on the gate electrodes 21. Moreover, insulating holding members 4 stand in a direction vertical to the spacers 5B. Transparent electrodes as data electrodes 7B are jointed to one end of the holding members 4, respectively, in a direction vertical to the holding members 4. The plural data electrodes 7B are arranged vertically to the gate electrodes 21 with predetermined gaps.

One ends of the films 80 are held by U-shaped concave sections formed by the plural spacers 5B, the holding members 4 and the data electrodes 7B, respectively so that a plurality of cantilevers which are arranged in a matrix pattern are formed. The films 80 have a length corresponding to the gap of the dada electrodes 7B, namely, the gap in the row direction of plurally formed U shapes and width corresponding to the gaps of the gate electrodes 21.

A bottom plate 8B is provided parallel with the transparent substrate 6B so as to be opposed to the surface of the transparent substrate 6B on the side where the films are supported. The second embodiment is similar to the first embodiment in that the opposed transparent substrate 6B and bottom plate 8B and the four wall members form the closed space and the transparent substrate 6B and the bottom plate 8B are separated so that the film 80 does not interfere with the bottom plate 8B.

Similarly to the first embodiment, the structure of the films 80 is constituted so that both surfaces of the ion-exchange film 1 as a polymeric electrolyte film are coated with the electrode films 2 and 3. It is the same as the first embodiment that the ion-exchange film 1 is hydrous. Moreover, it is also the same as the first embodiment that a voltage is applied to between the gate electrodes 21 and the data electrodes 7B so that a voltage is applied to between the upper electrode film and the lower electrode film and a potential difference is generated.

In this embodiment, a predetermined color is given to the upper electrode films 3 of the films 80. A base color such as black is given to the surface of the bottom plate 8B on the side of the films 80. When the matrix array unit 10B is observed from the side of the transparent substrate 6B, in the state that the films are not deformed, the pixels have the color which is given to the films, and in the state that the films are deformed, the pixels have the base color such as black. The films arranged in a matrix pattern are selectively deformed so that a two-dimensional image is created on the matrix array unit. The color given to the films is observed as a light image selectively displayed from the side on the transparent substrate 6B. When different colors such as R, G and B are given to the plural films, respectively, a multicolor light image (color image) is displayed.

In the second embodiment, control is made for each pixel as to whether a light is reflected by the films 80 without deforming the films 80 or the films 80 are deformed and a light is absorbed by the bottom plate 8B, so that a light image is created. Namely, in the second embodiment, a reflection type display device is realized.

Figure 6:
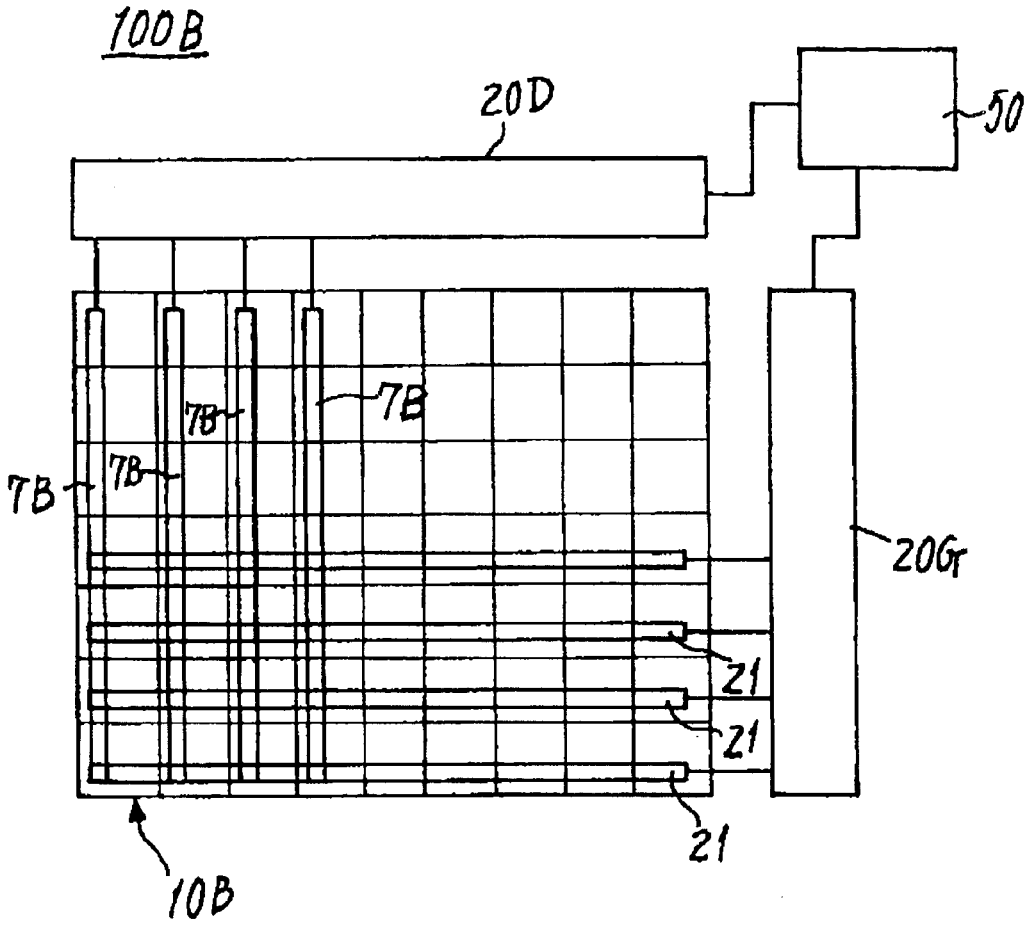
FIG. 6 is a plan view showing a circuit configuration of an image creating apparatus according to the second embodiment.

There will be explained below the structure for selectively deforming the plural films arranged in a matrix pattern with reference to FIG. 6. FIG. 6 is a plan view showing a circuit configuration of an image creating apparatus 100B. The image creating apparatus 100B is composed of the matrix array unit 10B, a gate circuit. 20G and a data circuit 20D.

The gate driving circuit 20G is connected to the plural gate electrodes 21 of the matrix array unit 10B. Moreover, the plural data electrodes 7B are connected to the data driving circuit 20D. The gate driving circuit 20G and the data driving circuit 20D are controlled by the controller 50, so that a voltage is selectively applied to the electrodes.

In the films 80 to which the voltage is applied, a potential difference is generated between the surfaces of the ion-exchange films 1 jointed to the upper electrode films 3 and the surfaces of the ion-exchange films 1 jointed to the lower electrode films 2. Due to this potential difference, the film 80 is curved to be deformed.

If a voltage having opposite polarity is applied from the data electrodes 7B, to which a voltage having certain polarity is applied from the gate electrodes 21, to certain pixels, an enough big potential difference is generated on the surfaces of the ion-exchange films 1 on the pixels and thus the films 80 of the pixels are deformed. Meanwhile, when a voltage is applied from the gate electrodes 21 to certain pixels and a voltage having the same polarity is applied also from the data electrodes 7B to the pixels, a potential difference of the ion-exchange films 1 becomes small. Therefore, the films 80 of the pixels can be prevented from being substantially deformed. When a voltage is applied selectively to the data electrodes 7B in the state that a voltage is applied to certain gate electrodes 21 in such a manner, the plural films 80 arranged in the rows corresponding to the gate electrodes 21 can be selectively deformed. The plural films 80 arranged two-dimensionally can be selectively deformed by simple matrix driving for selective deforming in the row direction for each row successively.

In order to execute such simple matrix driving, it is preferable that the material and structure of the films 80 are suitably selected and the deforming is enough small at a not more than certain voltage. Here, the films 80 may be deformed by the active matrix driving in which a switching element such as a thin film transistor (TFT) is provided for each pixel.

[Third Embodiment]

In the third embodiment, each of the closed spaces which is formed by the opposed transparent substrate 6B and bottom plate 8B and four wall members is charged with colored liquid in FIG. 5 of the second embodiment. As a result, in the state that the deformation of the films 80 is smaller, selection can be made between reflection and adsorption of a light.

Figure 7:
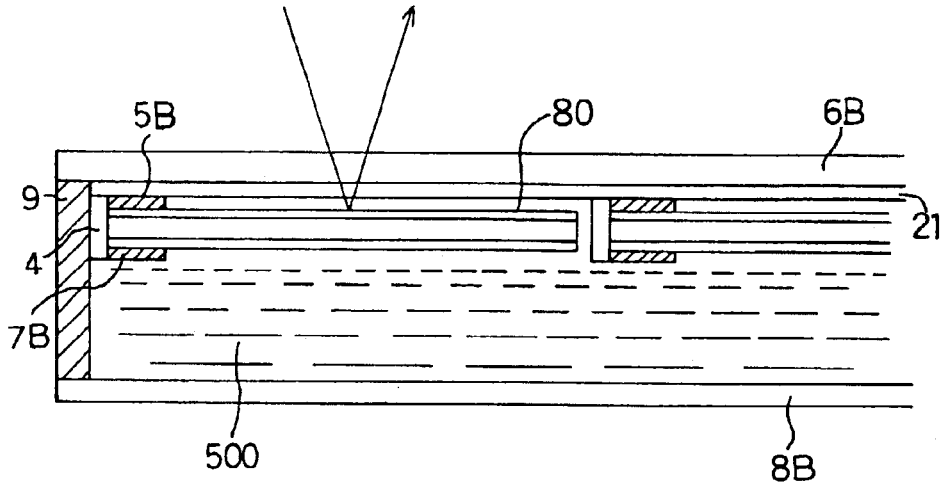
FIG. 7 is a diagram showing principle of a third embodiment: (a) shows a state that a voltage is not applied, and (b) shows a state that a voltage is applied.
Figure 7:
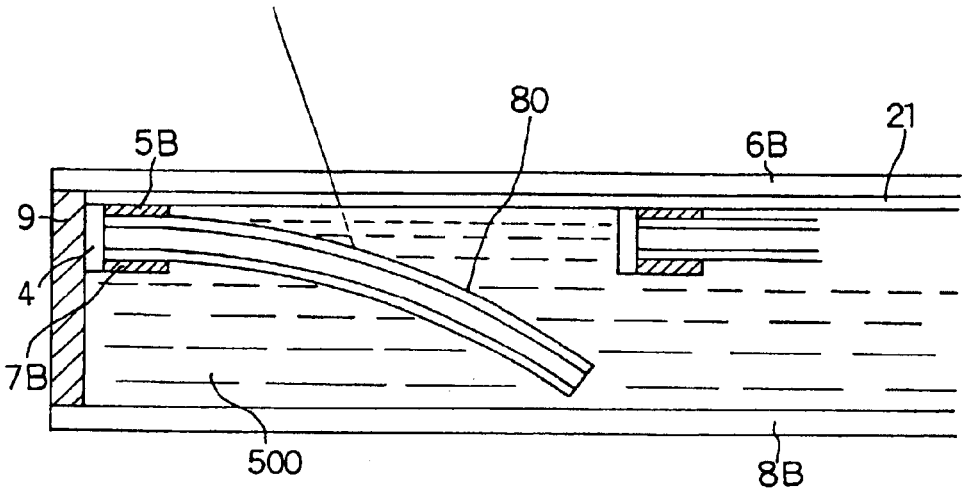

FIG. 7 is a cross sectional view showing principle of the third embodiment. In the state of FIG. 7 (*a*) (in the state that a voltage is not applied and the film 80 is not deformed), a liquid does not substantially exist between the transparent substrate 6B and the film 80, and a light is reflected by the surfaces of the films 80 similarly to the second embodiment. In the state of FIG. 7 (*b*) (in the state that a voltage is applied and the film 80 is deformed), a colored liquid exists between the transparent substrate 6B and the film 80, and thus reflection of a light by the film 80 is blocked.

In this embodiment, a type of a liquid with which the closed space is charged (color, transmittance or the like) is selected, so that a light can be absorbed efficiently. As a result, in comparison with the case where a liquid doe not exist or the case of a transparent liquid, adsorption of a light (namely, nonreflection on corresponding pixels) is achieved in the state that a deforming angle of the films 80 is small. This produces a responsibility improving effect such as reduction in a driving voltage and improvement of a switching speed of an image.

The third embodiment is similar to the second embodiment in that a charging colored liquid is black and the upper electrode films 3 of the films 80 are colored with different colors R, G and B, and thus a color display is possible.

In addition, in the present invention, the color display is possible by following another method. Namely, the upper surfaces of the upper electrode films 3 of the films 80 are surfaces having no wavelength dependency and having high reflectance, and the closed spaces to be charged with the colored liquid are charged with liquids for reflecting different colors such as R, G and B per pixel. As a result, each pixels can be represented by white (exactly, the state that a light is reflected by the upper surface of the electrode film 3), or a reflected color due to the colored liquid, so that a color image can be displayed.

Further, in the above similar structure, a charging liquid is a transmitting type colored liquid and an applying voltage is controlled with multi-step, so that a multi-value color display is possible. Namely, when an applying voltage is changed, the deforming angle of the film changes, so that a length of a path of the charging liquid through which an entered light passes when the light is reflected from the upper surfaces of the films 80 and is emitted therefrom changes. As a result, density (exactly, a light transmitting amount) of the emitted light colored with the charging liquid (exactly, wavelength is selected) as a reflected light to be observed changes, so that two-value display of reflection or nonreflection is not possible but a multi-value expression which can display an intermediate value between the two values is possible. Also in this case, the surface of the bottom plate 8B on the side of the films 80 is black, and in the case where the films 80 are deformed greatly, black can be expressed. Therefore, black, multi-gradation color and then white (exactly, the state that a light is reflected by the upper surface of the electrode film 3) can be expressed by one pixel.

[Fourth Embodiment]

In the fourth embodiment, another reflection-use film 200 which reflects a light intervenes between the transparent substrate 6B and the film 80 as a polymeric electrolyte film, and the closed space which is formed by the opposed transparent substrate 6B and bottom plate 8B is charged with a colored liquid.

Figure 8A:
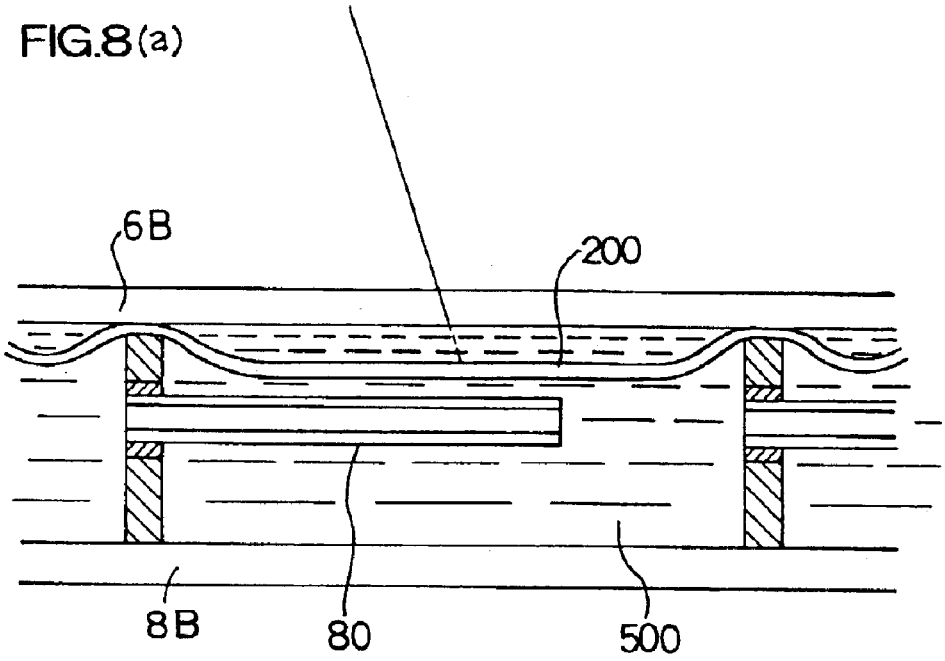
FIG. 8 is a diagram showing principle of a fourth embodiment: (a) shows a state that a voltage is not applied, and (b) shows a state that a voltage is applied.
Figure 8B:
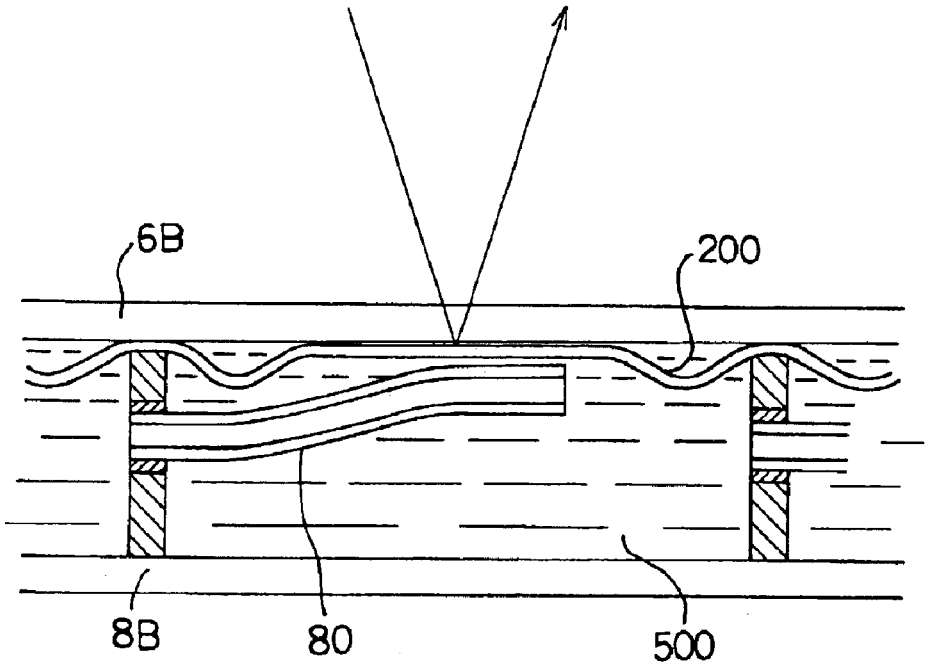

FIG. 8 is a cross sectional view showing principle of the fourth embodiment. The reflection-use film 200 is supported by the wall members and the transparent substrate 6B as shown in the drawing and the film 200 is deflected at the center of the pixel so as to separated from the transparent substrate 6B, and the film 80 is provided therebelow (side of the bottom plate 8B).

In the state of FIG. 8(*a*) (the state that a voltage is not applied and the reflection-use film 200 is not deformed), colored liquid exists between the transparent substrate 6B and the reflection-use film 200 so that reflection of a light is prevented. When a voltage is applied, the film 80 is deformed so as to push up the reflection-use film 200 and is in the state of FIG. 8(*b*). As a result, the colored liquid between the transparent substrate 6B and the reflection-use film 200 flows to a circumference, and the reflection-use film 200 substantially comes in close contact with the transparent substrate 6B so that a light is reflected.

Also in this embodiment, a type of a charging liquid (color, transmittance and the like) is selected, so that reflection/nonreflection of a light can be switched without enlarging the deforming angle of the film 80.

In addition, this embodiment is the same as the fourth embodiment in that the surface state of the reflection-use film 200 (color, reflecting condition or the like) and a type of charging liquid (color, reflection or transmitting type, or the like) are selected and color display is possible.

[Fifth Embodiment]

In the fifth embodiment, instead of the reflection-use film 200 of the fourth embodiment, a film 300 as the same polymeric electrolyte film as the film 80 is used.

Figure 9A:
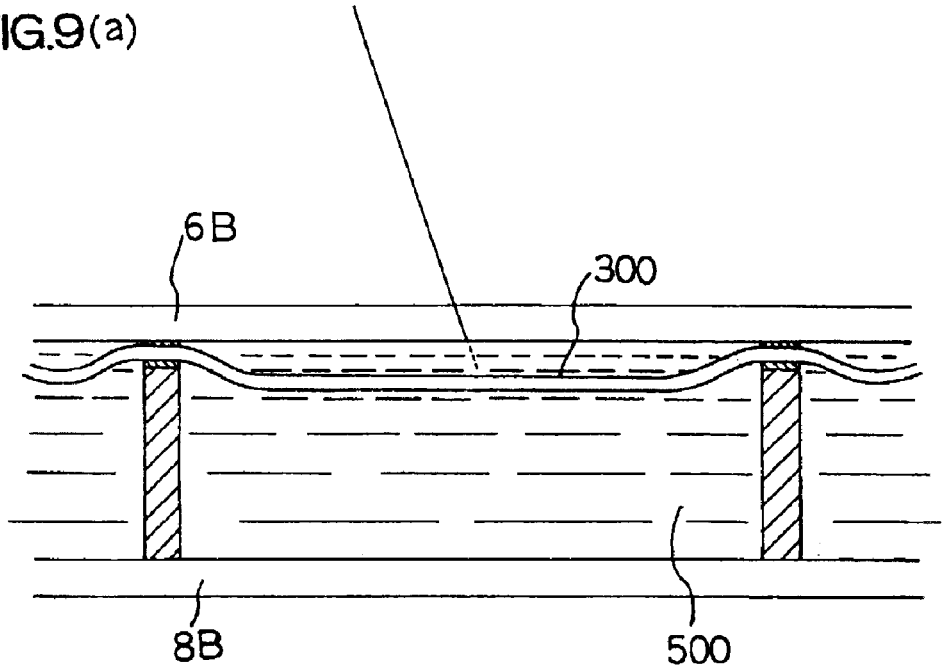
FIG. 9 is a diagram showing principle of a fifth embodiment: (a) shows a state that a voltage is not applied, and (b) shows a state that a voltage is applied.
Figure 9B:
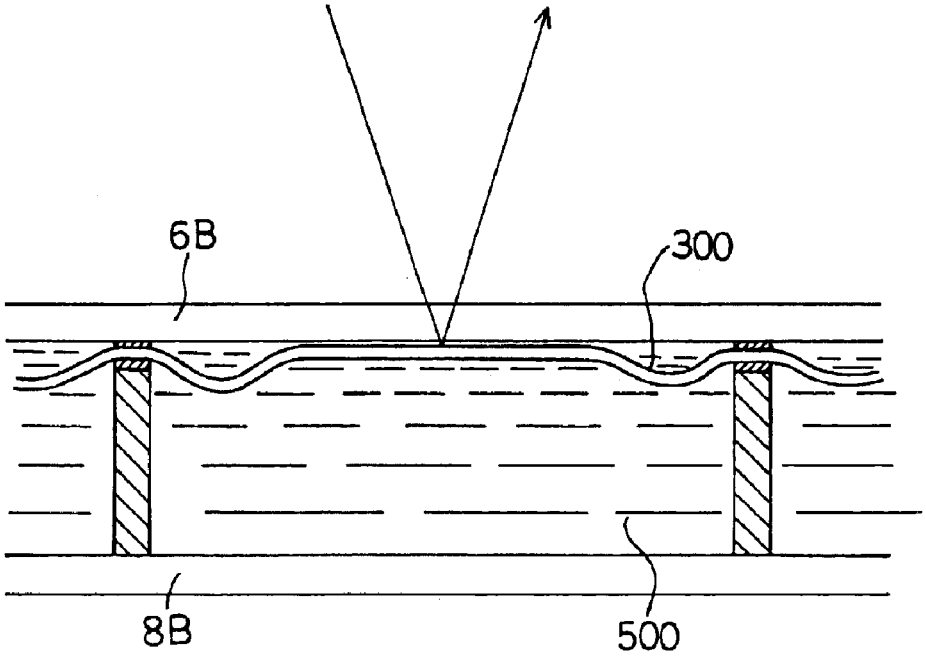

FIG. 9 is a cross sectional view showing principle of the fifth embodiment. The film 300 is supported by the wall members and the transparent substrate 6B in a continuing state as shown in the drawing, and the film 300 is deflected at the center of the pixel so as to be separated from the transparent substrate 6B. The closed space which is formed by the opposed transparent substrate 6B and the bottom plate 8B is charged with colored liquid.

In the state of FIG. 9(*a*) (the state that a voltage is not applied and the film 300 is not deformed), the colored liquid exists between the transparent substrate 6B and the film 300 so that reflection of a light is blocked. When a voltage is applied, the film 300 is deformed to be in the state of FIG. 9 (*b*). As a result, the colored liquid between the transparent substrate 6B and the film 300 flows to a circumference, and the film 300 substantially comes in close contact with the transparent substrate 6B so that a light is reflected.

Also in the present embodiment, the reflection/nonreflection of a light is achieved by small deformation of the film 300, and the responsibility improving effect such as reduction in a driving voltage and improvement in an image switching speed can be obtained. Furthermore, since one polymeric electrolyte film of the film 300 can be arranged along a plurality of pixels (for example, a band shape for each string), it is not necessary to arrange individual films as small pieces for each pixel like the other embodiments, so that elements can be easily manufactured. In the present embodiment, a voltage can be applied by various applying methods as well as the form of FIG. 6. Moreover, this example is the same as the fifth embodiment in that the surface state of the film 300 (color, reflecting condition or the like) and a type of charging liquid (color, reflection type or transmitting type or the like) are selected and the color display is possible.

[Experimental Example]

The experimental example is shown as an apparatus for creating a light image of a reflected light by deforming a polymeric electrolyte film. Firstly, in the structure of FIG. 5, the film as a movable piece was manufactured in such a manner that nickel was plated to a fluoroplastic cation-exchange film having a thickness of 20 $\mu$m and it was cut into a width of 1 mm and a length of 2 mm. The film 80 was mounted as a cantilever having the structure of FIG. 4 to the transparent substrate 6B. Further, the closed space was charged with pure water so that the film 80 was soaked in the pure water.

In such a structure, when a voltage of 1 V was applied to between the gate electrode 21 and the data electrode 7B, the film 80 was curved greatly. Moreover, thereafter the voltage was returned to 0 V, so that the film 80 was returned into the original shape. At this time, the surface of the bottom plate 8B opposed to the transparent substrate 6B was resin-coated with black so as to be black. Further, the nickel electrode of the upper electrode film 3 is thinly coated with white paint. Therefore, when observing from the side of the transparent substrate 6B, the pixel where the film 80 is curved is black, and the pixel where the film 80 is not deformed is white.

When density of black portion and whit portion was actually measured by using a reflection densitometer (Sakura DENSITOMETER PDA-65 made by Konica Corporation), the density of white was 0.3 and the density of black was 1.2 to 1.4.

[Modified Example]

In the above embodiments, the ion-exchange film was used as the film composing the movable piece. The ion-exchange film is excellent because a high responding speed of about 100 Hz can be obtained by a low driving voltage of several V, and the bending angle is sufficient. However, the movable piece in the image creating apparatus of the present invention is not limited to this, and another polymeric electrolyte film such as an electroconductive film, a ferro-electric polymer film or an organogel film may be used.

[Effect of the Invention]

As mentioned above, since the image creating apparatus of the present invention uses a polymeric electrolyte film as a movable piece on each pixel, the image creating apparatus which can be driven by a low voltage and driving speed of which is high can be provided.

Further, since a polymeric electrolyte film is a general-purpose film and can be obtained with low price, the manufacturing cost of the image creating apparatus can be reduced.

In addition, when the movable piece using the polymeric electrolyte film is compared with a movable piece using bi-metal or an electrostatic power, the image creating apparatus in which a degree of the curving deformation is higher and the contrast is higher can be provided.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image creating apparatus comprising:

a plurality of arranged polymeric electrolyte films;

a voltage applying device for applying a voltage to surfaces of the polymeric electrolyte films to generate a potential difference between the surfaces of the polymeric electrolyte films to which the voltage was applied so as to deform the polymeric electrolyte films, and a controller for controlling the voltage applying device so that a voltage is selectively applied to the plural polymeric electrolyte films for creating the image.

2. The image creating apparatus according to claim 1, wherein the voltage applying device applies a voltage to electrode films covering the polymeric electrolyte films so as to apply a voltage to the surfaces of the polymeric electrolyte films.

3. The image creating apparatus according to claim 2, wherein movable members are formed by the polymeric electrolyte films and the electrode films covering the polymeric electrolyte films in closed spaces, and the movable members are soaked in liquid put into the closed spaces.

4. The image creating apparatus according to claim 2, wherein movable members are formed by the polymeric electrolyte films and the electrode films covering the polymeric electrolyte films in closed spaces, and the surfaces of the movable members are colored.

5. The image creating apparatus according to claim 2, wherein movable members are formed by the polymeric electrolyte films and the electrode films covering the polymeric electrolyte films in closed spaces, and the movable members are soaked in colored liquid put into the closed spaces, and the movable members are bent by an angle of less than 90° so that switching of respective pixels is executed.

6. The image creating apparatus according to claim 5, wherein the polymeric electrolyte films have beltlike shapes and are provided along the plural pixels.

7. The image creating apparatus according to claim 1, wherein the image creating apparatus creates an image by a reflected light.

8. The image creating apparatus according to claim 1 further comprising:

a light source for irradiating a back surface of the image creating apparatus, wherein the image creating apparatus creates an image by a light which transmits through the apparatus.

9. The image creating apparatus according to claim 1 further comprising:

a resin coat for preventing evaporation being provided to circumferences of the polymeric electrolyte films.

10. The image creating apparatus according to claim 1, wherein the polymeric electrolyte films are substantially bent by not less than 90° so that switching of respective pixels are executed.

11. The image creating apparatus according to claim 1, wherein the plural polymeric electrolyte films are arranged two-dimensionally.

12. An image creating apparatus comprising:

a plurality of arranged polymeric electrolyte films;

a voltage applying device for applying a voltage to surfaces of the polymeric electrolyte films and generating a potential difference between both surfaces of the polymeric electrolyte films to which the voltage was applied to deform the polymeric electrolyte films;

a controller for controlling the voltage applying device so that a voltage is selectively applied to the plural polymeric electrolyte films, and flexible members which are arranged in vicinities of the polymeric electrolyte films, said flexible members are shifted by pressurizing of the polymeric electrolyte films.

13. The image creating apparatus according to claim 12 further comprising:

light transmitting members which are opposed to the flexible members, and a liquid held to peripheries of the flexible members to be capable of flowing, wherein the liquid between light transmitting members and the flexible members is pushed out when the flexible members are pressurized, and the liquid flows into between the light transmitting members and the flexible members at the time of releasing the pressurizing.

14. An image recording apparatus comprising:

an exposing device including:

a light source, and an image creating device being irradiated by the light source having:

a plurality of arranged polymeric electrolyte films;

a voltage applying device for applying a voltage to surfaces of the polymeric electrolyte films to generate a potential difference between both surfaces of the polymeric electrolyte films to which the voltage was applied so as to deform the polymeric electrolyte films, and a controller for controlling the voltage applying device so that a voltage is selectively applied to the plural polymeric electrolyte films, wherein the exposing device creates a light image by the light which transmits through the image creating device, said light image corresponds to selective deformation of the plural polymeric electrolyte films by means of the voltage applying device and the controller, and a photoreceptor for creating a electrostatic latent image by receiving the light image.

15. The image recording apparatus according to claim 14 further comprising:

a developer for developing the electrostatic latent image by toner.

16. An image creating apparatus comprising:

a plurality of arranged polymeric electrolyte films, and electrode films provided on surfaces of the polymeric electrolyte films, said electrode films are provided individually to the polymeric electrolyte films, wherein a voltage is selectively applied to the electrode films so that the polymeric electrolyte films can be selectively deformed for creating the image.

17. An image display apparatus comprising:

a plurality of arranged polymeric electrolyte films;

a voltage applying device for applying a voltage to surfaces of the polymeric electrolyte films to generate a potential difference between both surfaces of the polymeric electrolyte films to which the voltage was applied so as to deform the polymeric electrolyte films, and a controller for controlling the voltage applying device so that a voltage is selectively applied to the plural polymeric electrolyte films for displaying the image.

18. An image creating apparatus comprising:

a plurality of arranged polymeric electrolyte films, and electrode films provided on surfaces of the polymeric electrolyte films, said electrode films are provided individually to the polymeric electrolyte films, wherein a voltage is selectively applied to the electrode films so that the polymeric electrolyte films can be selectively deformed, and wherein movable members are formed by the polymeric electrolyte films and the electrode films covering the polymeric electrolyte films in closed spaces, and the movable members are soaked in liquid put into the closed spaces.

19. An image creating apparatus comprising:

a plurality of arranged polymeric electrolyte films, and electrode films provided on surfaces of the polymeric electrolyte films, said electrode films are provided individually to the polymeric electrolyte films, wherein a voltage is selectively applied to the electrode films so that the polymeric electrolyte films can be selectively deformed, and wherein movable members are formed by the polymeric electrolyte films and the electrode films covering the polymeric electrolyte films, and the surfaces of the movable members are colored.

20. An image creating apparatus comprising:

a plurality of arranged polymeric electrolyte films, and electrode films provided on surfaces of the polymeric electrolyte films, said electrode films are provided individually to the polymeric electrolyte films, flexible members which are arranged in vicinities of the polymeric electrolyte films, wherein a voltage is selectively applied to the electrode films so that the polymeric electrolyte films can be selectively deformed and the flexible members are shifted by pressurizing of the polymeric electrolyte films.

21. An image creating apparatus comprising:

a plurality of arranged polymeric electrolyte films, and electrode films provided on surfaces of the polymeric electrolyte films, said electrode films are provided individually to the polymeric electrolyte films, a resin coat for preventing evaporation being provided to circumferences of the polymeric electrolyte films.

wherein a voltage is selectively applied to the electrode films so that the polymeric electrolyte films can be selectively deformed.

* * * * *